US010145563B2

(12) United States Patent
Dora

(10) Patent No.: US 10,145,563 B2
(45) Date of Patent: Dec. 4, 2018

(54) METHOD FOR MANUFACTURING A GAS BURNER

(75) Inventor: Massimo Dora, Ospitaletto (BS) (IT)

(73) Assignee: SABAF S.P.A., Ospitaletto (BS) (IT)

( * ) Notice: Subject to any disclaimer, the term of this patent is extended or adjusted under 35 U.S.C. 154(b) by 1473 days.

(21) Appl. No.: 13/817,083

(22) PCT Filed: May 17, 2012

(86) PCT No.: PCT/IB2012/000960
§ 371 (c)(1),
(2), (4) Date: Apr. 22, 2013

(87) PCT Pub. No.: WO2013/171527
PCT Pub. Date: Nov. 21, 2013

(65) Prior Publication Data
US 2013/0306056 A1 Nov. 21, 2013

(51) Int. Cl.
*F24C 3/08* (2006.01)
*B22D 25/02* (2006.01)
(Continued)

(52) U.S. Cl.
CPC ..... *F24C 3/085* (2013.01); *B22C 9/00* (2013.01); *B22C 9/10* (2013.01); *B22C 9/101* (2013.01);
(Continued)

(58) Field of Classification Search
CPC ..... F23D 14/065; B22C 9/00; F24C 3/085
(Continued)

(56) References Cited

U.S. PATENT DOCUMENTS 1,952,500 A * 3/1934 Huetteman ..... B22C 9/24 164/368
2,346,720 A * 4/1944 Balcerzak ..... B22C 9/24 164/32

(Continued)

FOREIGN PATENT DOCUMENTS

WO WO 0202991 A1 1/2002
WO WO 2006/117815 A1 11/2006
WO WO 2012/001715 A1 1/2012

*Primary Examiner* — Avinash Savani
*Assistant Examiner* — Aaron Heyamoto
(74) *Attorney, Agent, or Firm* — Lucas & Mercanti, LLP

(57) ABSTRACT

Method for manufacturing a gas burner of the type comprising a cup, provided with at least one tubular tapered part of a mixer with axial Venturi effect, and shaped to couple with a burner head provided with at least one flame-spreader, wherein said cup is made in a single piece by casting or die-casting in an apposite mold. Such a method comprises, in sequence, the following steps:

a) arranging a mold with at least two shells, for casting or die-casting the afore said cup;
b) arranging at least one core which could be removably inserted into the respective mold, which has at feast one jutting portion shaped with at least one tubular tapered part of the stickle of the afore said mixer with axial Venturi effect;
c) inserting such a core into the mold and closing the afore said at least two mold shells so that the afore said at least one jutting portion of the core is retained, at least partially, at a distance from the opposite inner walls of the closed mold; the core and the mold being shaped so that at least one ending part of such a core replaces, at least partially, part of the perimetrical area of the cup defined by the mold;
d) pouring or pressure-injecting molten metal material into the closed mold;

(Continued)

e) opening the mold, drawing out the afore said core and then removing the die formed cup after the metal material is solidified;

f) applying at least one closing plug to the side hole (or side holes) of the die formed cup which corresponds/correspond to the ending part of the core which replaced part of the perimetrical area of the cup in the mold.

14 Claims, 4 Drawing Sheets

(51) Int. Cl.
*B22C 9/00* (2006.01)
*B22C 9/10* (2006.01)
*B22D 17/22* (2006.01)
*B22D 17/24* (2006.01)
*F23D 14/06* (2006.01)

(52) U.S. Cl.
CPC ..... *B22D 17/22* (2013.01); *B22D 17/24* (2013.01); *B22D 25/02* (2013.01); *F23D 14/065* (2013.01); *F23D 2213/00* (2013.01)

(58) Field of Classification Search
USPC ..... 126/39 E; 164/137
See application file for complete search history.

(56) References Cited

U.S. PATENT DOCUMENTS

2003/0155095 A1* 8/2003 Murayama ..... B22D 17/007 164/262
2009/0047611 A1* 2/2009 Armanni ..... F23D 14/065 431/284

* cited by examiner

METHOD FOR MANUFACTURING A GAS BURNER

CROSS-REFERENCE TO RELATED APPLICATION

This application is a 371 of PCT/IB2012/000960, filed May 17, 2012, the contents of which are incorporated herein by reference.

FIELD OF THE INVENTION

The present invention concerns a method for manufacturing a domestic gas burner of the type comprising a cup which is provided with at least one tubular tapered part of a mixer with axial Venturi effect, and preferably with the whole part with increasing section of such a mixer, and which is shaped as well to couple directly with a burner head provided with at least one flame-spreader.

BACKGROUND OF THE INVENTION

It is known in the art to realize gas burners, in particular domestic burners for cooking foods, that are substantially shaped in three or four separated parts which may be mutually assembled. In particular, it is known to realize gas burners composed of a cup, provided with coupling means to a hob, an intermediate body, or burner head, provided with one or more delivering chambers of the fuel mixture and at least one flame-spreader, integral with or separated from such an intermediate body, and with one or more closing lids. The cup is usually provided, as well, with means for feeding a fuel gas, or directly a fuel mixture, to the delivering chamber/chambers of the intermediate body and, in a lot of cases, it may be provided with a mixer, or part thereof, to mix the fuel gas with primary air coming from the outer environment.

Mainly in case wherein the burner is required to delivery a high thermal power, it is known to make at least one mixer with axial Venturi effect, having an horizontal axis or an axis tilted with respect to the horizontal line, connected to the burner cup, which has, as well, a support for at least one corresponding injector of the fuel gas arranged so that to direct the gas flow into such a mixer with axial Venturi effect.

The carrying out of a mixer with axial Venturi effect inside the burner cup, which is substantially a hollow tubular element provided with at least one region with a section gradually increasing from a region with a narrow section, usually needs the fastening of a number of metal parts, for example by welding, and/or complex chip removal machining, starting from one or more semi-finished items obtained by casting or die-casting.

In fact, the coupling of a hollow tubular body, as the mixer with axial Venturi effect, with a concave body, such as the cup, entails the presence of undercuts, and then it is not simple to be realized, above all if a cup in a single piece, or with the assembling of few components, is to be made. In this latter case, it is thus common to obtain a cup, by a casting or die-casting method in an apposite mould, in which the mixer with axial Venturi effect is made, completely or in part, separately from the cup and then it is inserted in the latter, and fastened thereto, only after these components have been die formed.

Such a method for manufacturing a gas burner with a cup provided with a mixer with axial Venturi effect, proves to be difficult to be implemented, complex to realize and very expensive.

It is then an object of the present invention to realize a method for the manufacturing of a burner provided with a cup having at least one tubular hollow part of a mixer with axial Venturi effect which does not present the drawbacks of the known previous art and then which allows to manufacture such a burner simply and not excessively expensive.

It is another object of the present invention to provide a method for the manufacturing of a burner provided with a cup having at least one part of the tubular region with an increasing section of a mixer with axial Venturi effect which leads to the manufacturing of a cup in a single piece, that thus has very resistant structure, and at the same time it is suitable for a gas burner designed to deliver a high thermal power.

It is another object of the present invention to realize a gas burner of the above mentioned type in which the cup, provided with at least part of the tubular region with an increasing section of a mixer with axial Venturi effect, is obtained as a whole by casting or die-casting, so that, in addition to be quick and easy to manufacture, it is also highly resistant from a mechanical point of view.

SUMMARY OF THE INVENTION

These and other objects are obtained by the method for manufacturing a gas burner according to the first independent claim and the subsequent dependent claims and by the gas burner according to the twelfth independent claim and the subsequent claims dependent thereto.

The method for manufacturing a gas burner of the type comprising a cup, provided with at least one tubular tapered part of a mixer with axial Venturi effect, and shaped to couple directly with a burner head provided with at least one flame-spreader, according to the present invention, provides that the cup is made in a single piece by casting or die-casting in an apposite mould, and it comprises, in sequence, the following steps:

a) arranging a mould with at least two shells, for casting or die-casting the afore said cup;
b) arranging at least one core which could be removably inserted into the respective mould, which has at least one jutting portion shaped with at least one tubular tapered part of the strickle (shape) of the afore said mixer with axial Venturi effect;
c) inserting such a core into the mould and closing the afore said at least two mould shells so that the afore said at least one jutting portion of the core is retained, at least partially, at a distance from the opposite inner walls of the closed mould; the core and the mould being shaped so that at least one ending part of such a core replaces, at least partially, part of the perimetrical area of the cup defined by the mould;
d) pouring or pressure-injecting molten metal material into the closed mould;
e) opening the mould, drawing out the afore said core and then removing the die formed cup after the metal material is solidified;
f) applying at least one closing plug to the side hole (or holes) of the die formed cup which corresponds to the ending part of the core which replaced part of the perimetrical area of the cup in the mould.

Such a method, which substantially uses a mobile core (carriage) with a cantilevered portion inside the mould to obtain as a whole the mixer with axial Venturi effect with the rest of the cup, proves to be simple to be carried out and it allows to decrease appreciably times and costs necessary for the manufacture of the above mentioned burner.

According to a preferred aspect of the present invention, the manufacturing method of the above reported gas burner provides that the removable core comprises as well part of the strickle of at least one distributing duct of the fuel mixture placed downstream of the outlet end of the mixer with axial Venturi effect.

In case in which the burner in productions provides, specifically, the presence of an annular chamber for delivering the fuel mixture, and then the use of one or more distributing ducts of the latter from the outlet end of the mixer with axial Venturi effect to such an annular delivering chamber is appropriate, the particular implementation of the above described manufacturing method proves to be highly inexpensive and effective.

In a particular embodiment of the manufacturing method of a gas burner herein claimed, the afore said step of f) applying at least one closing plug could be preceded by a step of g) chip removal machining from walls inside the tubular region of the cup, defined by the afore said at least one core, to realize, for example, a fluidic connection between the mixer with axial Venturi effect and the mixture distributing duct which are obtained thanks to the afore said removable core.

According to a further aspect of the present invention, the manufacturing method herein described concerns a gas burner in which the afore said mixer with axial Venturi effect comprises a tubular tapered portion with a section axially increasing from a region with a narrow section, and the afore said at least one jutting portion of the core is provided with the whole strickle of said tubular tapered portion with increasing section of the mixer with axial Venturi effect. In addition, preferably, such a core may comprise a supporting portion connected to the afore said jutting portion at the portion with greatest section of the afore said at least one tubular tapered part of the strickle of the mixer with axial Venturi effect.

According to another aspect of the present invention, a gas burner is provided, obtained by means of the above manufacturing method, comprising a burner cup, provided with at least one tubular tapered part of a mixer with axial Venturi effect, and shaped to couple with a burner head provided with at least one flame-spreader, wherein said cup is made in a single piece by casting or die-casting, and wherein at least part of the portion with increasing section of the mixer with axial Venturi effect is obtained as a whole, by casting or die-casting, with the afore said cup.

BRIEF DESCRIPTION OF THE DRAWINGS

For purposes of illustrations and not limitative, some preferred embodiments of the present invention will be provided with reference to the accompanying drawings, in which.

DETAILED DESCRIPTION OF SOME EMBODIMENTS OF THE PRESENT INVENTION

Figure 1:
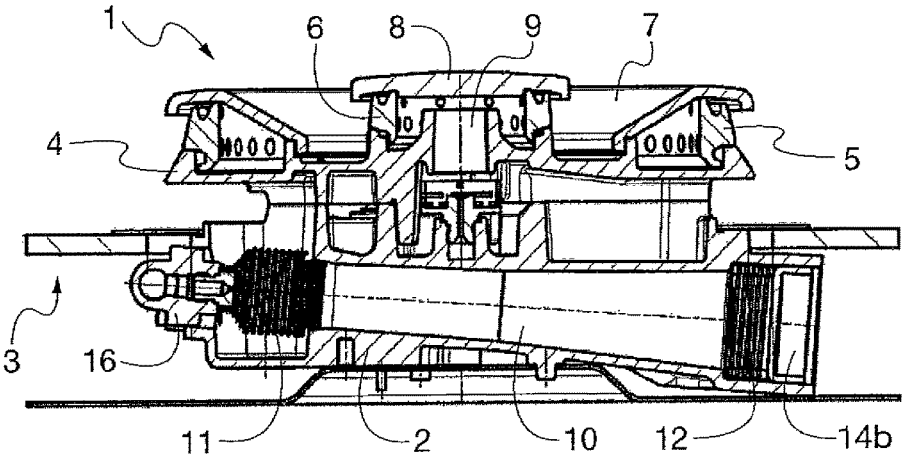
FIG. 1 is a side section view of a gas burner with several flame crowns realized according to a particular implementation of the manufacturing method according to an aspect of the present invention.
Figure 2:
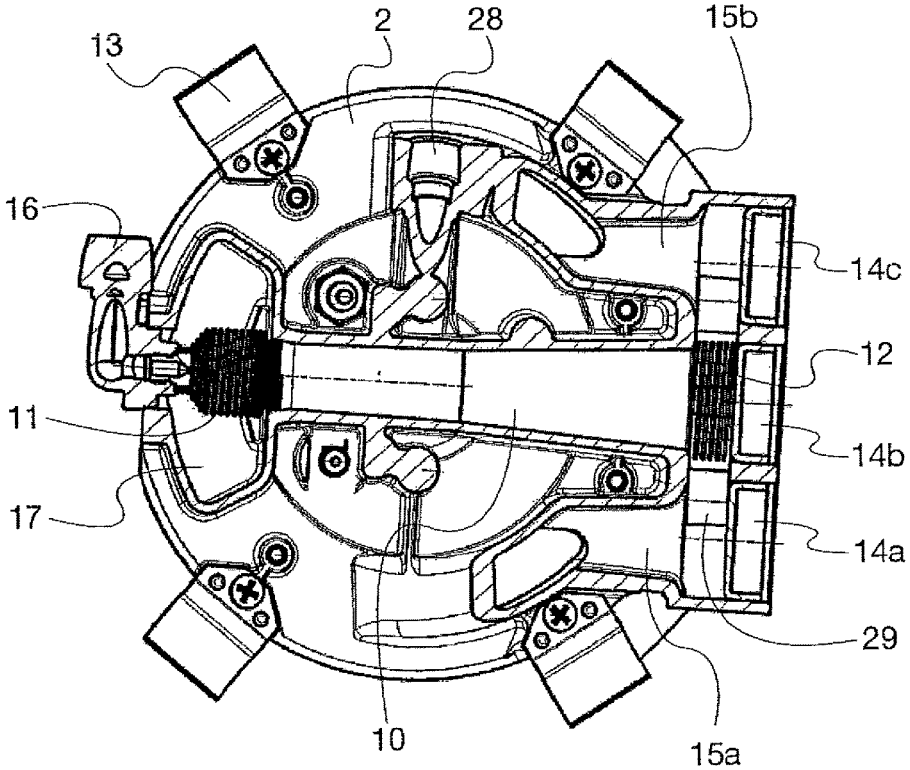
FIG. 2 is a top section view of the cup of the gas burner of FIG. 1.

FIGS. 1 and 2 shown, respectively, in a side section and in a top section of the cup 2 only, a gas burner 1 of the atmospheric type for domestic hobs which can be obtained by a characteristic implementation of the manufacturing method of a gas burner according to a distinctive aspect of the present invention.

Such a burner 1 comprises a cup 2 composed of a substantially concave body adapted to be placed inside a seat of a respective hob 3, a burner head 4 assembled—for example by juxtaposition of complementary parts—on the cup 2, two substantially concentric flame-spreaders 5, 6, disposed on the head of the burner 4, and top lids 7, 8 which enclose delivering chambers of the fuel mixture which are defined by the head of the burner 4 and the respective flame-spreaders 5, 6.

More in detail, the cup 2 comprises a mixer 10 of the axial Venturi effect type which, according to the known art, is substantially composed of a tubular body provided with an inlet region (on the left in FIGS. 1 and 2), a region with a narrow section, and a tapered region with a gradually increasing section, preferably of a truncated—cone shape (on the right in FIGS. 1 and 2).

It has to be noted that with the attribute "tubular" it is meant, herein and in the following, the characteristic shape of a hollow body developing mainly along an axis that is generally, but not necessarily, a straight axis, and which has a section defined by a closed perimetrical line, that is not necessarily constant along such a developing axis.

Such a mixer 10, in the particular embodiment of the burner 1 herein shown, has a substantially straight axis which is tilted of some degrees with respect to the horizontal line, and it ends into an ending chambers 29 connected to two distributing ducts 15*a*, 15*b*, which extend along part of the perimeter of the same cup 2 and connect fluidically the cup 2 to an annular delivering chamber of the fuel mixture present on the head of the burner 4.

It has to be observed that the mixer with axial Venturi effect 10 may alternatively develop along a substantially horizontal axis or anyway along an axis forming an angle lower than 45°, in the clockwise or anticlockwise way, with respect to the horizontal line, so that its outlet end may be directed upwards or downwards with respect to the horizontal line, even if with a rather little tilt.

The ending chamber 29, as can be seen in FIG. 2, has three outlet parallel holes 18*a*, 18*b*, 18*c* (see also FIG. 6), disposed on a side surface along the perimeter of the cup 2, which connect the outer environment to the outlet end of the mixer 10, that is the end of the tapered region with a gradually decreasing section of the latter, and they are blocked up by three respective plugs 14*a*, 14*b*, 14*c*.

The cup 2 comprises as well a support 16 for a first injector of fuel gas which is facing towards the inlet region of the mixer 10 with the aim of putting gas into the mixer 10 itself, and which is separated from the afore said inlet region of the latter by an inflow well 17 of the primary air from the outer environment. The well 17, as can be seen in particular in FIG. 1, is shaped to communicate the outer environment over the hob 3 with such an inlet region of the mixer 10.

In the particular embodiment of the burner 1 herein shown, a tubular pierced body, for example being composed of a metal spiral spring 11, is placed between the support 16 of the injector and the inlet region of the mixer 10, inside part of the well 17, and has the function of preventing the possible propagation of flames coming from the well 17 itself into the mixer 10. Similarly, in the burner 1 herein shown, it is present another pierced tubular body, also preferably composed of a metal spiral spring 12, interposed between the outlet end of the mixer 10 and a bottom surface of the afore said ending chamber 29, having the function of preventing the possible propagation of flames coming from the ducts 15*a*, 15*b* connected to such a chamber 29. More in detail, it has to be observed that the spring 12, having the function of preventing the flame propagation inside the mixer 10, is assembled between the outlet section, that is the ending section of the tapered region with increasing section, of the same mixer with axial Venturi effect 10 and the central plug 14*b* of the ending chamber 29.

The cup 2 is further provided with a duct 28 and a support (not shown in figures) for a second injector, substantially with vertical axis, shaped to direct the fuel gas towards a mixer with radial Venturi effect 9 obtained in the head of the burner 4, as well as means 13 for constraining the same cup 2 to a hub 3.

Such a cup 2, according to the present invention, is made in a single piece by casting or die-casting and it is shaped to allow the head of the burner 4 to be assembled thereon firmly, for example thanks to the juxtaposition of complementary parts.

The head of the burner 4, also preferably obtained in a single piece, comprises the structure of a mixer with radial Venturi effect 9 placed in a central body defining part of a central delivering chamber of the fuel mixture, and an annular body, concentric to the central chamber, which has part of a chamber, annular too, for delivering the same fuel mixture.

The central chamber of the burner head is completed by a flame-spreader ring 6, provided with notches and/or holes for the outflow of the fuel mixture to be ignited, and by a top lid 8, which closes the chamber of the afore said central body and acts as upper wall of the mixer with radial Venturi effect 9.

The annular delivering chamber of the head of the burner 4 is defined, on the contrary, next to at least part of its side surface, by a flame-spreader 5, annular too and provided with notches and/or holes for the outflow of the fuel mixture, and by a top lid 7 which closes such an annular chamber. It has to be noticed that, in the particular embodiment of the burner 1 herein shown, the annular delivering chamber of the fuel mixture and the central delivering chamber are separated one from another, also if in another embodiments they could be fluidically connected one to another.

Alternatively, the herein described burner may have only one annular body defining, with a respective flame-spreader or lid, an annular delivering chamber of the fuel mixture, or only one central body which defines, with its flame-spreader or lid, only one central delivering chamber of the mixture.

It has further to be noticed that, in the particular burner 1 herein described, the afore mentioned annular delivering chamber of the fuel mixture of the head of the burner 4 is fed by the mixer with axial Venturi effect 10 obtained in the cup 2 thanks to the distributing ducts 15*a*, 15*b*, also obtained at least in part in the same cup 2, which communicate fluidically the same mixer 10 with such an annular chamber of the head of the burner 4 and then with the flame-spreader 5. On the contrary, as already described, the central chamber of the head of the burner 4 is fed by the mixer with radial Venturi effect 9, which is obtained in the same head of the burner 4.

In alternative embodiments, herein not shown, the mixer with axial Venturi effect 10 may feed both the delivering chambers of the fuel mixture of the head of the burner 4, or in any case any one of the one or more delivering chambers of the mixture present on the burner head.

Figure 8:
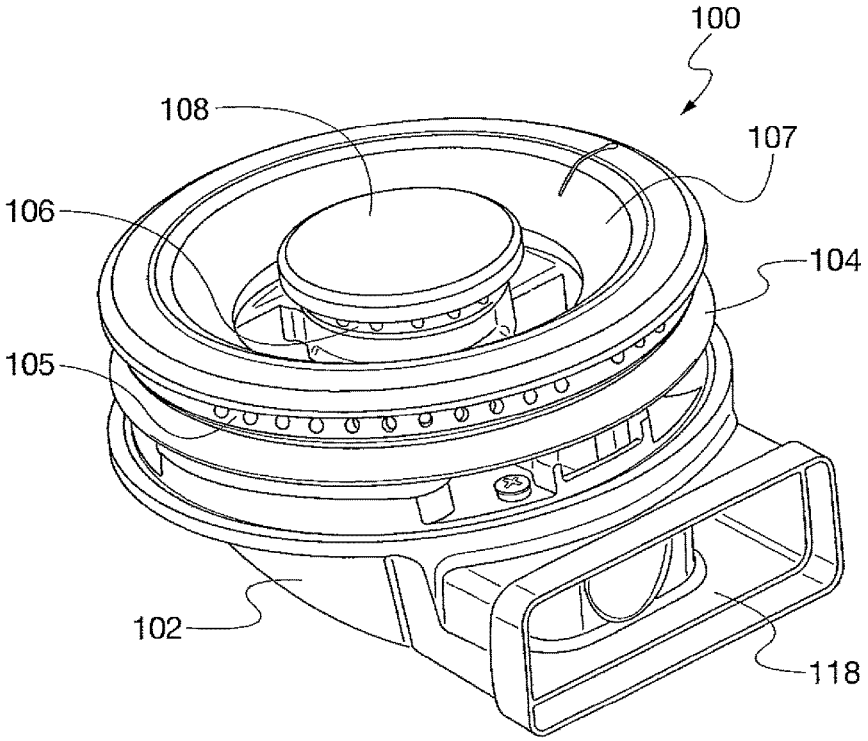
FIG. 8 is a perspective view of a gas burner obtained according to a further embodiment of the manufacturing method according to a further aspect of the present invention.

Now referring also to FIG. 8, a further gas burner 100 is represented, of the atmospheric type and adapted for domestic use for cooking foods, which is similar to the afore described one referring to FIGS. 1 and 2 and which is different therefrom only for the presence of only one perimetrical hole 118 obtained in a perimetrical area of the respective cup 102, and intended to be covered by an appropriate plug (herein not represented).

In particular, the burner 100 comprises a cup 102 provided with a mixer with axial Venturi effect and two distributing ducts, placed on part of the perimeter in plant of the same cup 102, and fluidically connected to the outlet end of the same mixer, a head of the burner 104 assembled by juxtaposing parts on the cup 102 and shaped with a central body and an annular body, as well as two flame-spreaders 105, 106 respectively defined by side walls of the afore said central body and annular body of the head of the burner 104, and two upper lids 107, 108.

As afore mentioned, the manufacturing of the burner 1 above, according to a preferred aspect of the present invention, provides that the cup 2, equipped with at least one tubular tapered part of the mixer with axial Venturi effect 10, but preferably equipped with the whole mixer 10, is realized in a single piece by casting or die-casting in an apposite mould.

In the same way, the manufacturing of the burner 100 too, represented in FIG. 8, provides that the cup 102 is made as a whole and that the latter is similar to the cup 2 of the burner 1, except for the presence of only one outer perimetrical hole 118 in place of the three distinct holes 18*a*, 18*b*, 18*c* of the cup 2.

Referring now to FIGS. 3-7, the method for manufacturing the cup 2 (or the cup 102) of the burner 1 (or the burner 100) comprises, in sequence, the following steps. First of all (step (a)) the arrangement of a mould 40, of the type comprising at least two shells closable one to another, is needed, the mould negative-reproducing the outer strickle of the cup 2 (or 102) in its inside. Such a mould 40, once the two shells are closed one to another—of which only one is represented and indicated with the numeric reference 20—, has to allow the entrance of a metal material, for example aluminum, in a liquid (molten) state, in case and preferably under pressure.

Figure 3:
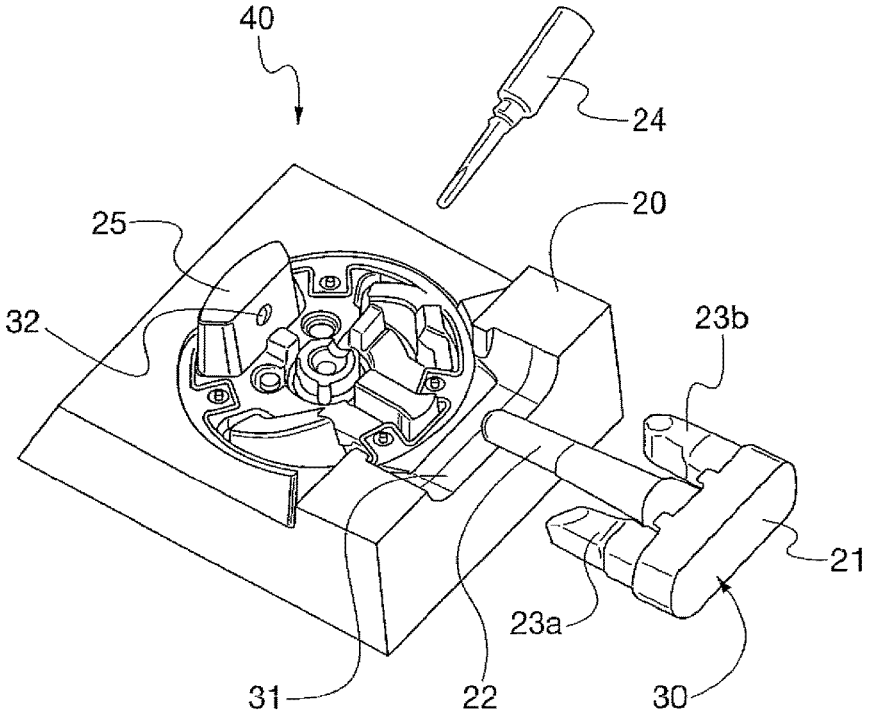
FIG. 3 is a schematic perspective view of a part of a die-casting mould, with the cores not inserted, that may be used to carry out a particular implementation of the manufacturing method of a gas burner according to an aspect of the present invention.

Then (step (b)) at least one first core 30, shaped to be removably combined with the mould 40, has to be realized and arranged. As can be seen in FIG. 3 or in FIG. 4, such a core 30, made in a material which has to resist structurally to the molten metal material, is inserted preferably into an impression 31, obtained on one or both the shells 20 at a side portion of the mould 40 itself, and it can be sustained by a further seat, or support, 32 obtained in the mould 50 in a position opposite to the position of the impression 31.

Figure 4:
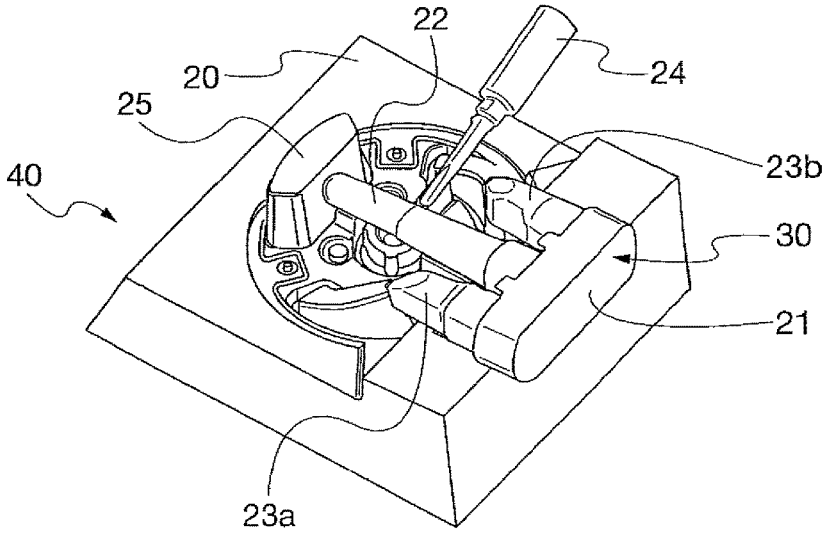
FIG. 4 is a schematic view of part of the mould of FIG. 3 with the core inserted therein.

The core 30 comprises at least one jutting portion 22 reproducing the inner strickle of the mixer with axial Venturi effect 10, or at least one tubular tapered part thereof and which, as can be seen schematically in FIG. 4, when the core 30 is combined with the mould 40 and the latter is closed, is spaced apart from at least part of the opposite walls of the two shells of the mould 40, such that such a jutting portion 22, during the casting or injection of the molten metal material, defines a tubular hollow body—that is at least in part of the mixer with axial Venturi effect 10—placed inside the cup 2.

According to a particular aspect of the manufacturing method of the present invention, such a jutting portion 22 of the core 30 is shaped to reproduce at least in part, but preferably at least the wholeness, of the tubular tapered region with a gradually increasing section of the mixer with axial Venturi effect 10 and, preferably, also the whole region with narrow section of the latter.

The jutting portion 22 of the core 30 is cantileverly supported, in the particular embodiment of the present invention herein described, by at least one supporting portion 21 of the same core 30, which is placed at one end of the latter and it is shaped as well to removably couple with the impression 31 of the mould 22 and thereby to retain juttingly, except for the possible engagement with the afore said support 32, such a portion 22 inside the same mould 40, as it is closed.

Then the supporting portion 21 of the core 30, being disposed just at one end of the latter, may be used to handle the core 30 itself during the introduction and the drawing out thereof from the mould 40, so that the core 30 is substantially a shaped carriage which could be driven to enter and exit from the mould 40 due to such a supporting portion 21.

In the following step (step c)) of the manufacturing method of a cup of a gas burner herein illustrated, the introduction of the core 30 into the two shells of the mould 40 is provided, and the closing thereof, before the subsequent step (step (d)) of injecting, or pouring, a metal material in the liquid (molten) state.

The fact that the core 30 could be inserted and drawn out from the mould 40 to realize the cup 2 (or 102), entails that at least an ending part of the core 30 replaces part of the perimetrical area of the cup 2 (or 102) which has to be obtained by means of the mould 40. This causes the formation of at least one hole 18*a*, 18*b*, 18*c*, or 118, inside the cup 2 (or 102) itself, corresponding to such an ending part of the core 30 which replaces part of the perimetrical area of the cup 2 (or 102).

Such an ending part, as it will be evident, may coincide with the supporting portion 21, creating only one hole 118 (see FIG. 8) in the cup 102 drawn out from the mould 40, for example, or it may coincide with part of the jutting portion 22, creating for example a number of distinct holes 18*a*, 18*b*, 18*c* in the cup 2 coming out from the mould 40.

It has to be observed that, according to a particular aspect of the present invention, the supporting portion 21 of the core 30 is connected to the respective jutting portion 22 at the part reproducing the strickle of the mixer with axial Venturi effect 10 having the greatest section, so that such a jutting portion 22 of the core 30 is tapered from its part connected to the supporting part 21 up to its free end which has a smaller section, corresponding to at least part of the region with narrow section of the mixer 10.

Such a free end of the jutting portion 22 of the core 30, according to another aspect of the present invention, may be supported inside the mould 40, as referred, by the afore mentioned seat 32, which could be preferably obtained at a projection 25, realized on the shell 20 and adapted to negative reproduce the afore said well 17. In this way, after the cup 2 has been drawn out from the mould 40, the strickle of the mixer with axial Venturi effect 10 reproduced by the jutting portion 22 of the core 30 is connected to the strickle of the well 17, defined by the lug 25 of the shell 20.

According to a particular aspect of the manufacturing method of a gas burner herein described, the jutting portion 22 of the core 30 comprises as well two bodies 23*a*, 23*b* which leave from that region of the core 30 defining at least the tubular tapered part with increasing section of the mixer with axial Venturi effect 10 and reproduce at least part of the strickle of the two distributing ducts 15*a*, 15*b* of the cup 2 (or 102).

As can be seen more in detail in FIGS. 3 and 4, these bodies 23*a*, 23*b* of the jutting portion 22 of the core 30, defining the afore said distributing channels 15*a*, 15*b* of the fuel mixture, are preferably cantileverly supported too by the afore said supporting portion 21 of the core 30 itself and they are placed, mutually parallel, sideways the jutting portion 22 defining at least one tubular tapered part—but preferably the wholeness—of the strickle of the mixer with axial Venturi effect 10.

According to a particular aspect of the present manufacturing method of the cup 2 (or 102), before the step of (d) pouring or injecting a metal material into the mould 40, it is possible to realize and then to arrange (step (h)) at least one second core 24, which can also be removably inserted into the mould 40 and which comprises at least one jutting portion with at least part of the strickle of a duct, which may be, for example in the cup 2 (or 102) of the burner 1 (or 100) herein described, the inflow duct 28 of the fuel gas towards the injector for the mixer with radial Venturi effect 9 obtained in the head of the burner 4.

In case such a second core 24 is realized before the step of (d) pouring or pressure-injecting a metal material in the liquid state, it is obviously needed to insert the second core 24 into the mould 40, by coupling it, before the shells of the mould are closed.

Then returning back to the manufacturing method of the cup 2 (or 102) of the gas burner 1 (or 100), after the step (step (d)) of pouring or, preferably, pressure-injecting a metal material in the liquid (molten) state, a step (step (e)) of opening the mould 40, drawing out the core 30 and in case the core 24 and removing the cup 2 (or 102) is provided, after the cup is solidified.

As said, an ending part of the core 30, having at least part of the tubular tapered strickle of the mixer with axial Venturi effect 10, replaces, during the die forming of the cup 2, at least part of the perimetrical surface of the latter, producing at least one hole 118 or 18*a*, 18*b*, 18*c*.

At this point, then, the manufacturing method of the cup 2 (or 102) provides that (step (f)) a plug is applied, or several plug 14*a*, 14*b*, 14*c*, to the hole 118 or holes 18*a*, 18*b*, 18*c*, obtained by the afore said ending part of the core 30 replacing part of the perimetrical surface of the cup 2 or 102.

It has to be noticed that, because of the core 30 provides that the respective jutting portion 22 has a strickle at least in part substantially of a truncated—cone shape, that is with increasing, also if not necessarily even, section, the drawing out of the core 30 itself from the mould 40 has to happen necessarily from the portion with greatest section of such a jutting portion 22 and then at the outlet end, with greatest section, of the mixer with axial Venturi effect 10 realized by such a core 30 during the die forming of the cup 2 or 102. It means that the hole 118, or holes 18*a*, 18*b*, 18*c*, are placed downstream the mixer with axial Venturi effect 10 and then the plug, or plugs 14*a*, 14*b* and 14*c*, which could be made in a synthetic or metal material, have the function to prevent the fluidic communication of the outlet end of such a mixer 10 with the outer environment.

As already mentioned, the ending part of the core 30 replacing part of the perimetrical area of the cup 2, or 102, during the die forming, could make one or several distinct holes in the die formed cup 2 or 102, obviously depending on the strickle of the core 30 engaging with such a perimetrical area of the cup 2 or 102.

So, considering for illustration purpose only the core 30 shown in FIGS. 3 and 4, provided with a supporting portion 21 from which a jutting portion 22 in the shape of hay fork separates, in case in which the supporting portion 21, substantially prismatic, of the core 30 replaces—in the mould 40 during the die forming—a perimetrical area of the cup 102, only one hole 118 is obtained, which can be seen in the burner 100 of FIG. 8, whereas in case in which an ending part of the jutting portion 22 of the core 30 replaces—during the die forming—a perimetrical area of the cup 2, then two or more holes 18*a*, 18*b*, 18*c* may be formed, as can be seen in the cup 2 shown schematically in FIGS. 1, 2, 5, 6, and 7.

Figure 5:
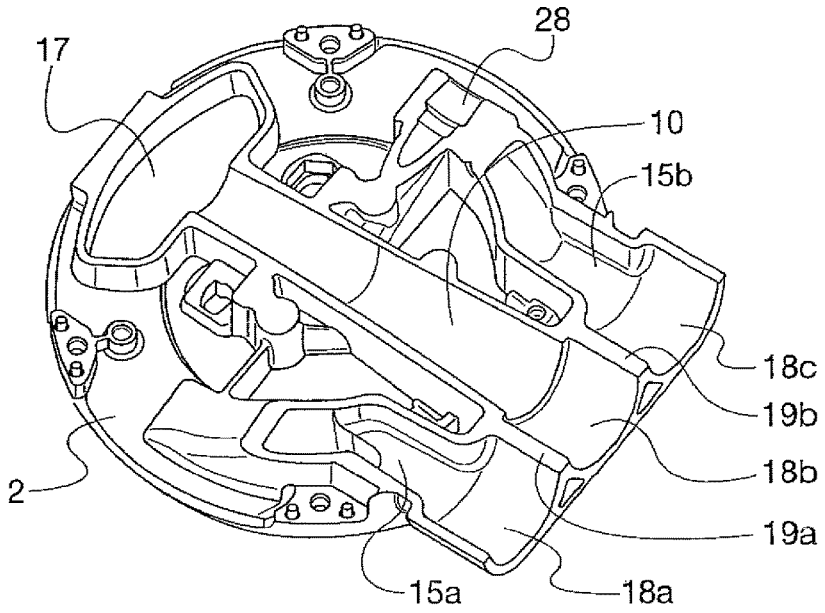
FIG. 5 is a perspective section view of the burner cup, not yet refinished, drawn out from a mould of the type represents in FIGS. 3 and 4 immediately after its solidification.

In the latter case, as illustrated in FIG. 5, in the cup 2 drawn out from the mould 40, the holes 18*a*, 18*b*, 18*c* correspond to tubular ducts 10, 15*a*, 15*b* separated one from another by diaphragms 19*a*, 19*b*. Therefore, if it is necessary, as in the burner 1 herein illustrated, to cause the duct of the mixer with axial Venturi effect 10 to connect fluidically to the distributing ducts 15*a*, 15*b* of the fuel mixture, then the manufacturing method herein described provides that (step (g)) a chip removal machining is carried out, for example by means of cutters 27*a*, 27*b* (see FIG. 7), on walls inside the tubular region defined by the jutting portion 22 of the core 30.

Figure 6:
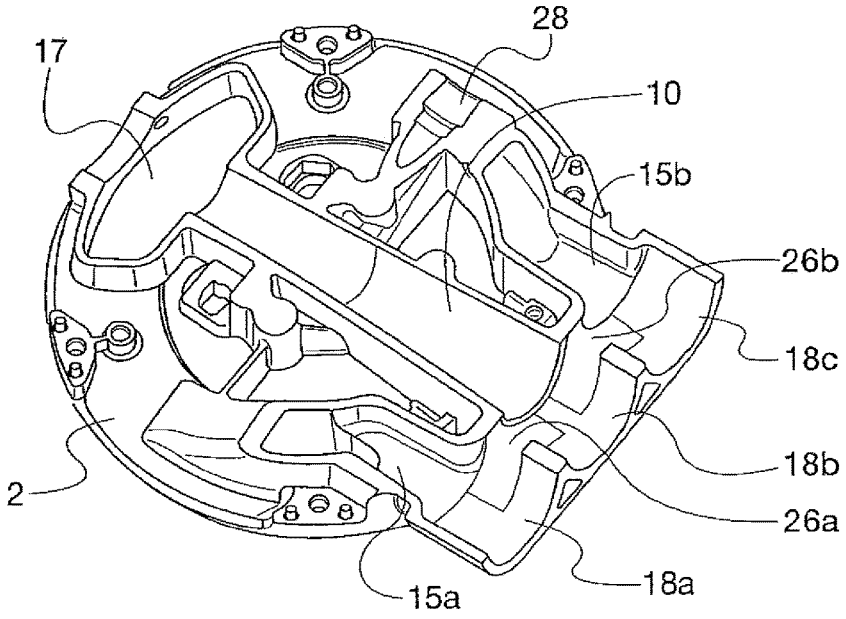
FIG. 6 is a perspective section view of a cup burner shown in FIG. 5, after having been subjected to a refinishing working.
Figure 7:
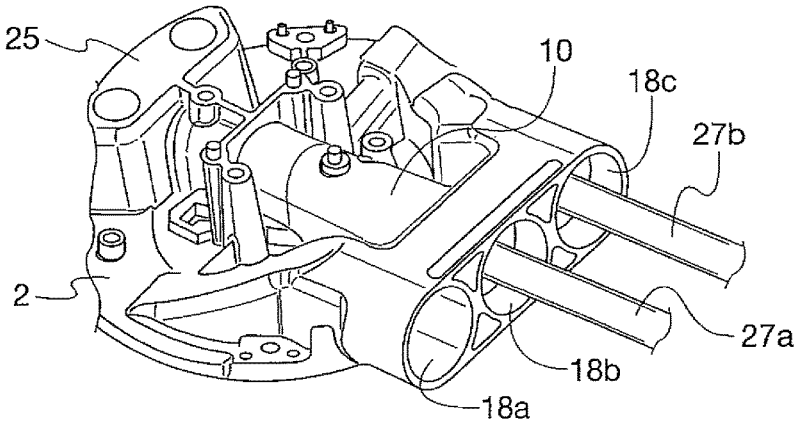
FIG. 7 is a perspective view of part of a cup drawn out from a mould of the type represented in FIGS. 3 and 4, and subjected to a refinishing working by chip-removal cutting, according to a particular aspect of the manufacturing method according to a particular aspect of the present invention.

In particular, in the cup 2 herein shown in FIGS. 5, 6 and 7, said cutters 27*a*, 27*b* are inserted into the holes 18*a*, 18*b*, 18*c* to eliminate, by chip removing, the diaphragms 19*a*, 19*b* and thus to create the passages 26*a*, 26*b* of fluidic communication between the mixer with axial Venturi effect 10 and the distributing ducts 15*a*, 15*b* of the fuel mixture, and therefore to realize the afore said ending chamber 29, placed downstream the mixer 10.

It has to be noted that, also if a chip removal machining is herein described intending to communicate fluidically three tubular ducts inside the cup 2 and obtained due to the jutting portion 22 of the core 30, any other chip removal machining inside the tubular region defined by such a jutting portion 22 coming from the step of pouring or injecting the molten metal material into the mould 40 is possible as well, in combination or alternatively to the machining afore described, and then it falls within the protection scope herein demanded.

After such a chip removal machining, whatever it is, the manufacturing method herein described provides, in case of the burner 1, for the positioning of several plugs 14*a*, 14*b*, 14*c* to close the holes 18*a*, 18*b*, 18*c* and thereby to obtain the cup 2 shown in the herein attached FIGS. 1 and 2.

Referring to the core 30 herein represented in FIGS. 3 and 4, in case in which the supporting portion 21 of the core 30 replaces part of the perimetrical area of the cup 102, the hole made in such a perimetrical area is that one which is indicated by the numeral reference 118 in the burner 100 of FIG. 8, and then the ducts 15*a* and 15*b* will be connected to the outlet end of the mixer with axial Venturi effect 10, without the need of carrying out any chip removal machining inside the tubular region realized by the core 30.

As the person skilled in the art will have appreciated from the description above, the above described manufacturing method of a gas burner 1, 100 allows to simply, effectively and economically obtain a cup 2, 102 provided with a mixer with axial Venturi effect, on which a respective head of the burner 4, 104 could be assembled, for example, with flame-spreaders 5, 6; 105, 106 and respective lids 7, 8; 107, 108.

The invention claimed is:

1. Method for manufacturing a gas burner comprising a cup, the cup comprising at least one tubular tapered part of an axial Venturi effect mixer configured to receive air from an outer environment, and shaped to couple with a burner head provided with at least one flame-spreader, wherein said cup is made in a single piece by casting or die-casting in an apposite mold, characterized by comprising in sequence the following steps:

a) arranging a mold with at least two shells, for the casting or die-casting of said cup;

b) arranging at least one core to be removably inserted into said mold, said core having at least one jutting portion shaped with at least one tubular tapered part of the strickle of said axial Venturi effect mixer configured to receive air from an outer environment;

c) inserting said at least one core into the mold and closing said at least two mold shells, at least one ending part of said at least one core replacing, at least partially, part of the perimetrical area of the cup defined by said mold, said at least one jutting portion of said at least one core being retained as well, at least partially, at a distance from the opposite inner walls of the closed mold;

d) pouring or pressure-injecting molten metal material into said closed mold;

e) opening the mold, drawing out said core and then removing said die formed cup, after the metal material is solidified;

f) applying at least one closing plug to at least one side hole of the die formed cup corresponding to the ending part of said at least one core which replaces part of the perimetrical area of the cup in the mold.

2. Method according to claim 1, wherein said at least one jutting portion of said core comprises as well at least part of the strickle of one or more distributing ducts of the fuel mixture.

3. Method according to claim 1, wherein said at least one core comprises a supporting portion connected to said at least one jutting portion at the portion with greatest section of said at least one tubular tapered part of the strickle of said axial Venturi effect mixer.

4. Method according to claim 2 wherein at least part of the strickle of one or more distributing ducts of the fuel mixture is connected to said supporting portion of said core.

5. Method according to claim 4, wherein said at least one jutting portion comprises at least one tubular tapered part of the strickle of said axial Venturi effect mixer and at least part of the strickle of at least two distributing ducts of the fuel mixture, said at least one tubular tapered part of the strickle of said axial Venturi effect mixer being interposed between the strickle parts of said at least two distributing ducts.

6. Method according to claim 1, wherein in that said step of f) applying at least one closing plug is preceded by a step of g) chip removal machining from walls inside the tubular region defined by said at least one core in said cup.

7. Method according to claim 1, wherein said step f) comprises applying two or more closing plugs for at least two or more side holes of the die formed cup corresponding to parts of said at least one jutting portion of said core which replace part of the perimetrical area of the cup in the mold.

8. Method according claim 1, wherein said mold comprises at least one support for a free end of said jutting portion of said core.

9. Method according to claim 1 by comprising, before said step of d) pouring or pressure-injecting molten metal material, the steps of:

h) arranging a second core which could be removably inserted into said mold, said second core having at least one jutting portion defining at least part of a duct;

i) inserting said second core into the mold and closing said at least two shells of the mold;

and wherein said step e) comprises as well the step of drawing out said second core too before removing the die formed cup, after the metal material is solidified.

10. Method according to claim 1, wherein said axial Venturi effect mixer comprises a tubular tapered portion with a section increasing from a region with a narrow section, wherein said at least one jutting portion of said at least one core is provided with at least the whole strickle of said tubular tapered portion with increasing section of said axial Venturi effect mixer.

11. Method according to claim 1, wherein said at least one tubular tapered portion of said axial Venturi effect mixer develops along a substantially horizontal axis or along an axis forming an angle of less than 45° with respect to the horizontal line.

12. Gas burner obtained by a method according to claim 1, comprising a burner cup, provided with at least one tubular tapered part of said axial Venturi effect mixer configured to receive air from an outer environment, and shaped to couple with a burner head provided with at least one flame-spreader, wherein said cup is made in a single piece by casting or die-casting, wherein at least part of the portion with increasing section of said axial Venturi effect mixer is obtained as a whole, by casting or die-casting, with said cup.

13. Gas burner according to claim 12, wherein said burner head comprises at least one annular delivering chamber and at least one respective flame-spreader, the latter being disposed at least on a side portion of said annular chamber, said annular chamber being fed by at least said axial Venturi effect mixer, by distributing ducts of the fuel mixture at least in part obtained in said burner cup.

14. Gas burner according to claim 12, said cup has at least one side surface hole, closed by an appropriate plug, said hole being placed at one end of said axial Venturi effect mixer.

* * * * *